US007367389B2

(12) United States Patent
Duggan et al.

(10) Patent No.: US 7,367,389 B2
(45) Date of Patent: May 6, 2008

(54) TUBING EXPANSION

(75) Inventors: Andrew Michael Duggan, Westhill (GB); Simon John Harrall, Houston, TX (US); Paul David Metcalfe, Aberdeen (GB); David John Hillis, Balmedie (GB); Wayne Rudd, Newcastle Upon Tyne (GB)

(73) Assignee: Weatherford/Lamb, Inc., Houston, TX (US)

( * ) Notice: Subject to any disclaimer, the term of this patent is extended or adjusted under 35 U.S.C. 154(b) by 237 days.

(21) Appl. No.: 10/869,502

(22) Filed: Jun. 16, 2004

(65) Prior Publication Data

US 2006/0052936 A1 Mar. 9, 2006

(30) Foreign Application Priority Data

Jun. 16, 2003 (GB) ..... 0313891.4
Nov. 15, 2003 (GB) ..... 0326670.7

(51) Int. Cl.
*E21B 23/00* (2006.01)

(52) U.S. Cl. ..... 166/207; 166/380; 166/384; 166/277

(58) Field of Classification Search ..... 166/384, 166/380, 207, 277
See application file for complete search history.

(56) References Cited

U.S. PATENT DOCUMENTS 3,203,451 A * 8/1965 Vincent ..... 138/143
3,776,307 A 12/1973 Young
4,976,322 A 12/1990 Abdrakhmanov et al.
5,014,779 A 5/1991 Meling et al.
5,031,699 A 7/1991 Artynov et al.
5,957,195 A 9/1999 Bailey et al.
6,454,013 B1 9/2002 Metcalfe
6,543,552 B1 * 4/2003 Metcalfe et al. ..... 175/57
6,575,240 B1 6/2003 Cook et al.
6,648,075 B2 * 11/2003 Badrak et al. ..... 166/381
6,668,930 B2 * 12/2003 Hoffman ..... 166/298
6,708,767 B2 3/2004 Harrall et al.
6,860,329 B1 3/2005 Oosterling
2002/0166664 A1 11/2002 Lauritzen et al.

(Continued)

FOREIGN PATENT DOCUMENTS

EP 0 353 309 11/1988

(Continued)

OTHER PUBLICATIONS

U.K. Search Report, Application Serial No. GB0413397.1, dated Sep. 3, 2004.

(Continued)

*Primary Examiner*—William P. Neuder
*Assistant Examiner*—Nicole Coy
(74) *Attorney, Agent, or Firm*—Patterson & Sheridan, L.L.P.

(57) ABSTRACT

There are disclosed methods and apparatus for expanding tubing downhole.

In one embodiment, there is disclosed a method of expanding downhole tubing such as a liner (10), the method comprising the steps of locating the liner (10) in a borehole (12), expanding a part (16) of the liner (10) in the borehole (12), locating an expansion device such as an expandable cone (18) in said expanded part (16) of the liner (10), and translating the cone (18) relative to the liner (10) to expand a further part (20) of the liner (10).

6 Claims, 2 Drawing Sheets

U.S. PATENT DOCUMENTS

| | | | | |
|---|---|---|---|---|
| 2005/0045342 | A1 | 3/2005 | Luke et al. | |
| 2005/0056433 | A1* | 3/2005 | Ring et al. | 166/384 |
| 2005/0150660 | A1* | 7/2005 | Cook et al. | 166/380 |
| 2006/0065408 | A1* | 3/2006 | Green et al. | 166/384 |
| 2006/0266527 | A1* | 11/2006 | Brisco et al. | 166/380 |

FOREIGN PATENT DOCUMENTS

| | | |
|---|---|---|
| EP | 0 397 870 | 11/1988 |
| EP | 0 397 874 | 11/1988 |
| GB | 2 374 101 | 10/2002 |
| GB | 2 401 131 | 11/2004 |
| RU | 2 187 619 | 8/2002 |
| WO | WO 01/18354 | 3/2001 |
| WO | WO 01/98623 | 12/2001 |
| WO | WO 02/29199 | 4/2002 |
| WO | WO 02/053867 | 7/2002 |
| WO | WO 02/066783 | 8/2002 |
| WO | WO 03/006788 | 1/2003 |
| WO | WO 03/029607 | 4/2003 |
| WO | WO 03/036018 | 5/2003 |
| WO | WO 03/042487 | 5/2003 |
| WO | WO 03/071086 | 8/2003 |
| WO | WO 03/083258 | 10/2003 |
| WO | WO 03/102365 | 12/2003 |
| WO | WO 2004/027205 | 4/2004 |
| WO | WO 2004/083594 | 9/2004 |
| WO | WO 2004/085790 | 10/2004 |
| WO | WO 2004/089608 | 10/2004 |
| WO | WO 2004/092527 | 10/2004 |
| WO | WO 2004/092528 | 10/2004 |
| WO | WO 2004/094766 | 11/2004 |
| WO | WO 2005/003511 | 1/2005 |

OTHER PUBLICATIONS

GB Search Report dated Feb. 10, 2004 from GB Application No. 0326670.7.

GB Search Report dated Nov. 14, 2003 from GB Application No. 0313891.4.

* cited by examiner

TUBING EXPANSION

CROSS-REFERENCE TO RELATED APPLICATIONS

This application claims benefit of Great Britain patent application serial number GB 0313891.4, filed Jun. 16, 2003, and Great Britain patent application serial number GB 0326670.7, filed Nov. 15, 2003 which are herein incorporated by reference.

BACKGROUND OF THE INVENTION

1. Field of the Invention

The invention relates to tubing expansion. In particular, but not exclusively, the invention relates to methods and apparatus for expanding tubing downhole.

2. Description of the Related Art

A significant recent development in the oil and gas exploration and production industry has been the introduction of expandable bore-lining tubing, that is tubing which may be run into a drilled bore and then expanded to a larger diameter. The tubing may take any appropriate form, including but not limited to casing, liner or sandscreen. Various methods have been proposed for expanding the tubing downhole, including the use of expansion cones or mandrels that are pushed or pulled through the tubing and are mechanically and/or fluid pressure driven. Alternatively, a rotary expander may be utilised, that is, a device including a number of rollers, each roller with an axis of rotation generally parallel to the tubing axis. The expander is rotated within the tubing with the rollers in rolling contact with the tubing inner surface. The rollers may define a fixed diameter, or may be mounted to permit radial movement.

Each expansion device has its own advantages and disadvantages. One disadvantage of using a fluid-driven expansion cone is that the cone, which of course describes a diameter larger than the tubing to be expanded, must be initially accommodated within a larger diameter section of the tubing, which those of skill in the art sometimes refer to as a "garage" or "launcher". This launcher is provided at the lower end of the tubing, and the end of the launcher, beyond the cone, may be selectively sealed and then pressured-up to push the cone upwardly through the tubing. Of course, this larger diameter tubing section limits the dimensions of the minimum diameter restriction that the assembly, including the remainder of the smaller diameter tubing, may pass through while being run into the bore. To minimise this limiting effect, the wall thickness of the launcher may be thinner than the wall thickness of the tubing to be expanded. However, this reduces the strength of the tubing which forms the launcher, such that the launcher may be more susceptible to damage as the tubing is run into the bore, which would interfere with the ability to launch the cone. Furthermore, having a relatively thin wall reduces the ability of the launcher to withstand the elevated pressures which are required to drive the cone through the tubing.

It is among the objectives of embodiments of the present invention to obviate or mitigate these difficulties.

SUMMARY OF THE INVENTION

According to a first aspect of the present invention, there is provided a method of expanding tubing comprising the steps of:

locating the tubing in a borehole;

expanding a part of the tubing in the borehole;

locating an expansion device in said expanded part of the tubing; and translating the expansion device relative to the tubing to expand a further part of the tubing.

Expanding said part of the tubing in this fashion may create a garage or launcher for the expansion device in the downhole environment. This avoids or minimises the requirement to provide a larger diameter portion of tubing to accommodate the device and subsequently running the tubing into the borehole, thereby avoiding or minimising the difficulties discussed above.

In embodiments of the invention, a force may be exerted on the expansion device through a tubing string, wireline, tubing tractor (such as that disclosed in the applicant's UK patent application no.0012772.0, the disclosure of which is incorporated herein by way of reference) or a combination thereof, to locate the expansion device in said expanded part of the tubing. The expansion device may then be translated relative to the tubing to expand said further part by application of a fluid pressure force on the expansion device and/or by application of a further force through the tubing string or the like. Where the expansion device is translated at least partly by application of a force through the tubing string, this may be achieved in one procedure, by exerting one long, substantially continuous pull/push on the expansion device, or in a series of short pulls/pushes or pulses. For example, a hydraulic jack or piston assembly may be provided as part of a string of tubing coupled to the expansion device, which may be arranged for exerting a series of pull forces on the expansion device. This may be achieved by supplying fluid pressure to translate a piston of the jack (and thus the expansion device) a short distance relative to the tubing, and then translating a cylinder of the jack ready for a subsequent further movement of the piston.

The expansion device may be initially located further down or deeper in the borehole than said part of the tubing to be expanded. Following expansion of said part of the tubing, the expansion device may then be translated relative to the tubing in a direction up the borehole to locate the expansion device in said expanded part of the tubing.

Alternatively, the expansion device may be initially located further up or shallower in the borehole than said part of the tubing to be expanded. Following expansion of said part of the tubing, the expansion device may then be translated relative to the tubing in a direction down the borehole to locate the expansion device in said expanded part of the tubing.

The expansion device may be located in said expanded part by carrying the expansion device into said part of the tubing during expansion thereof. Alternatively, said part of the tubing may be expanded and the expansion device may then be located in said part.

The tubing may be located in the borehole and the expansion device may be run into the borehole in a separate procedure, subsequent to location of the tubing in the borehole. Alternatively, the tubing may be run into the borehole together with the expansion device. Thus the expansion device may be provided as part of a tubing string carrying the tubing and the expansion device.

Preferably, the method comprises expanding said part of the tubing using a first expansion device, locating a second expansion device in said expanded part of the tubing and then translating the second expansion device relative to the tubing to expand said further part of the tubing. Most preferably, the first and second expansion devices are run into the borehole together and may be coupled together to form an expansion apparatus. The tubing may therefore be expanded in a single run. Alternatively, the first and second expansion devices may be run into the borehole separately, to expand said part and said further part of the tubing in two distinct expansion procedures. In a further alternative, said part of the tubing and said further part may be expanded using a single expansion device. For example, the expansion device may be initially located at least partly externally of the tubing. The expansion device may then be translated relative to the tubing by exerting a force on the expansion device through a tubing string, a wireline, a tubing tractor or the like, to expand said part of the tubing. The expansion device may thus reside within said expanded part, and may then be further translated relative to the tubing to expand said further part of the tubing, for example, by application of an applied fluid pressure force.

Said part of the tubing may be expanded using an expansion device having a variable diameter. The variable diameter expansion device may be run into the borehole in a retracted configuration and subsequently moved to a larger diameter expansion configuration for expanding said part of the tubing.

Said part of the tubing may be expanded by translating the expansion device relative to the tubing over a desired length thereof. In embodiments of the invention, said part of the tubing may be expanded using a rotary expander device having a plurality of radially movable expansion members (such as that disclosed in the applicant's International patent publication no WO 00/37766, the disclosure of which is incorporated herein by way of reference). The rotary expander device may be rotated and/or translated relative to the tubing to expand said tubing part. It will be understood that the device/expansion members may be dimensioned such that said part of the tubing is expanded purely by rotating the device without translating the device relative to the tubing. Thus said expanded part may extend over a relatively short length of the tubing.

Alternatively, said part of the tubing may be expanded using a fixed diameter expansion device such as a cone or mandrel, or by any other suitable method such as by application of fluid pressure, inflating an inflatable expansion member, or the like.

Said further part of the tubing may be expanded using a collapsible expansion device, which may be located in said expanded part of the tubing in a collapsed configuration and moved from the collapsed configuration to an expansion configuration describing a larger, expansion diameter. Locating the collapsible expansion device in said part of the tubing in the collapsed configuration facilities subsequent movement of the expansion device to the expansion configuration. This is because the device can be moved to the expansion configuration with little or no force exerted on the tubing by the expansion device during this movement, depending on relative dimensions of the tubing and the expansion device. Subsequent to movement to the expansion configuration, the collapsible expansion device may then be translated relative to the tubing to expand said further part of the tubing. Said further part of the tubing may be expanded using a collapsible expansion device such as that disclosed in the applicant's UK patent application No. 0304335.3 and European patent publication No. 0862681, the disclosures of which are incorporated herein by way of reference.

Said part of the tubing may be expanded to an internal diameter substantially equal to a maximum expansion diameter described by the expansion device. This may facilitate location of the expansion device in said part of the tubing, as location of the expansion device in said part may be achieved with little or no expansion of the tubing. This may be of particular utility where the expansion device used to expand said further part of the tubing is a collapsible device. Alternatively, said part of the tubing may be expanded to an internal diameter greater than or less than said expansion diameter of the expansion device.

The end of the tubing located in the borehole may, at least initially, be closed relative to the borehole, optionally at an end of the tubing in the borehole, or between said end and the expansion device, such as in said expanded part of the tubing. This may facilitate application of a fluid pressure force on the expansion device to translate the device relative to the tubing by, for example, supplying fluid under pressure to a location between said end of the tubing and the expansion device. To facilitate translation of the expansion device under such applied fluid pressure, the expansion device may be substantially self-sealing in the tubing, or may carry a seal such as a wiper seal. The closed end may be selectively opened, for example, subsequent to expansion of said further part of the tubing, to open communication with the borehole through the expanded tubing, and may be opened by removing part of the tubing, such as by drilling or milling the tubing. The tubing may be closed by providing a removable, for example, drillable, liner at said end of the tubing, the liner removed/drilled out to open the tubing end, or using a seal such as a packer or the like.

Alternatively, the end of the tubing located in the borehole may, at least initially, be open to the borehole. This may allow the expansion device to be located at least partly externally of the tubing and may facilitate use of a fixed diameter expansion device (such as a cone, mandrel or fixed diameter roller expander device, or a compliant roller expander device such as that disclosed in the applicant's International patent publication No. WO03/048503, the disclosure of which is incorporated herein by way of reference). The open end may be selectively closed or sealed prior to or during expansion of said further part of the tubing. This may facilitate application of a fluid pressure force to translate the expansion device, and subsequent opening of the tubing, as described above.

According to a second aspect of the present invention, there is provided a method of expanding tubing comprising the steps of:

locating the tubing in a borehole;

expanding a part of the tubing in the borehole;

locating a collapsible expansion device in said expanded part of the tubing in a collapsed configuration;

moving the collapsible expansion device from the collapsed configuration to an expansion configuration describing a larger, expansion diameter; and translating the collapsible expansion device relative to the tubing to expand a further part of the tubing.

Further features of the method are described above in relation to the first aspect of the invention.

According to a third aspect of the present invention, there is provided a method of forming a garage in an expandable tubing, the method comprising the steps of:

locating expandable tubing in a borehole; and then expanding at least part of the tubing to form a garage in the tubing having a larger internal diameter than a remainder of the tubing.

According to a fourth aspect of the present invention, there is provided tubing expansion apparatus comprising:

a first expansion device for expanding part of a tubing located in a borehole; and a second expansion device adapted to be located in said expanded part of the tubing and to be translated relative to the tubing to expand a further part of the tubing.

The apparatus may be adapted to be located in the tubing subsequent to location of the tubing in the borehole. Alternatively, the apparatus may be adapted to be located in the tubing prior to location of the tubing in the borehole. Thus the apparatus may be adapted to be run into the borehole together with the tubing, and may be initially coupled to the tubing.

Preferably, the first and second expansion devices are adapted to be run into the borehole together and may be coupled together. Alternatively, the first and second expansion devices may be adapted to be run into the borehole separately, to expand said part and said further part of the tubing in two distinct expansion procedures.

The apparatus may be coupled to a tool string such as coiled tubing, or a wireline, and/or may be coupled to or comprise a tubing tractor (such as that disclosed in GB 0012772.0), or the like. This may serve for translating the first expansion device relative to the tubing to expand said part of the tubing. Preferably, the second expansion device is adapted to be translated relative to the tubing at least partially by application of a fluid pressure force on the second expansion device and/or by application of a further force through the tubing string or the like described above.

Preferably, the first expansion device has a variable diameter, and may be movable between a retracted configuration and a larger diameter expansion configuration for expanding said part of the tubing. In embodiments of the invention, the first expansion device may take the form of a rotary expander device having a plurality of radially movable expansion members (such as disclosed in WO 00/37766). The first expansion device, in particular the expansion members of the device, may be dimensioned such that said part of the tubing is expanded purely by rotating the first expansion device without translating the device relative to the tubing.

Preferably also, the second expansion device is a collapsible expansion device which is movable between a collapsed configuration and an expansion configuration describing a larger, expansion diameter. The second expansion device may be adapted to be located in said expanded part of the tubing in the collapsed configuration and moved from the collapsed configuration to the expansion configuration. The second expansion device may take the form of a collapsible cone such as that disclosed in the applicant's UK patent application No. 0304335.3 and European patent publication No. 0862681. Alternatively, the second expansion device may take the form of a fixed diameter expansion device such as a cone or mandrel.

The first expansion device may be adapted to expand said part of the tubing to an internal diameter substantially equal to a maximum expansion diameter described by the second expansion device. As described above, this may facilitate location of the second expansion device in said expanded part of the tubing. Accordingly, the first expansion device may describe an expansion diameter substantially equal to an expansion diameter of the second expansion device. Alternatively, the first expansion device may be adapted to expand said part of the tubing to an internal diameter greater than or less than said expansion diameter of the expansion device. Accordingly, the first expansion device may describe an expansion diameter greater than or less than an expansion diameter of the second expansion device.

According to a fifth aspect of the present invention, there is provided tubing expansion apparatus comprising:

means for expanding part of a tubing located in a borehole; and an expansion device adapted to be located in said expanded part of the tubing and to be translated relative to the tubing to expand a further part of the tubing.

Preferably, the means for expanding said part of the tubing comprises or takes the form of a first expansion device, and the apparatus includes a second expansion device for expanding said further part of the tubing. Alternatively, the means for expanding said part of the tubing may comprise an assembly for exerting a fluid pressure force on said part of the tubing. For example, the assembly may comprise at least two seals such as inflatable packers adapted to be located spaced apart in the tubing above the expansion device, for isolating part of the tubing between the seals. This may facilitate supply of a fluid under pressure to the tubing between the seals to expand said part of the tubing.

The second expansion device may be substantially self-sealing in the tubing, or may carry a seal such as a wiper seal. This,may facilitate generation of a fluid pressure force on the second expansion device to translate the device relative to the tubing.

According to a sixth aspect of the present invention, there is provided an expandable tubing assembly comprising an expandable tubing adapted to be located in a borehole, and tubing expansion apparatus for expanding the expandable tubing, the tubing expansion apparatus comprising:

a first expansion device for expanding part of the tubing in the borehole; and a second expansion device adapted to be located in said expanded part of the tubing and to be translated relative to the tubing to expand a further part of the tubing.

The end of the tubing located in the borehole may, at least initially, be closed relative to the borehole, optionally at an end of the tubing in the borehole, or between said end and the second expansion device, such as in said expanded part of the tubing. The second expansion device may be substantially self-sealing in the tubing, or may carry a seal such as a wiper seal. The closed end may be adapted to selectively opened, for example, subsequent to expansion of said further part of the tubing, to open communication with the borehole through the expanded tubing, and may be drillable. The assembly may further comprise a removable, for example, drillable, liner at said end of the tubing, which may be adapted to be removed/drilled out to open the tubing end, or may comprise a seal such as a packer or the like.

Alternatively, the end of the tubing located in the borehole may, at least initially, be open to the borehole. The second expansion device may be a fixed diameter expansion device, such as a cone, mandrel or fixed diameter roller expander device, or a compliant roller expander device such as that disclosed in WO03/048503. The open end may be adapted to be selectively closed or sealed prior to or during expansion of said further part of the tubing, and the apparatus may comprise an inflatable seal/packer or the like for closing said end.

BRIEF DESCRIPTION OF THE DRAWINGS

Embodiments of the present invention will now be described, by way of example only, with reference to the accompanying drawings, in which.

DETAILED DESCRIPTION OF DRAWINGS

FIGS. 1-4 illustrate steps in a method of expanding tubing 10 located within a borehole 12, in accordance with a preferred embodiment of the present invention.

The tubing 10 typically takes the form of an expandable casing or liner located in open hole (an unlined portion of the borehole 12). However, it will be understood that the tubing 10 may equally be located within a string of tubing (not shown) residing in the borehole 12, such as a conventional casing, and the tubing 10 may, for example, take the form of a patch or straddle for repairing a deteriorated section of the casing.

Figure 1:
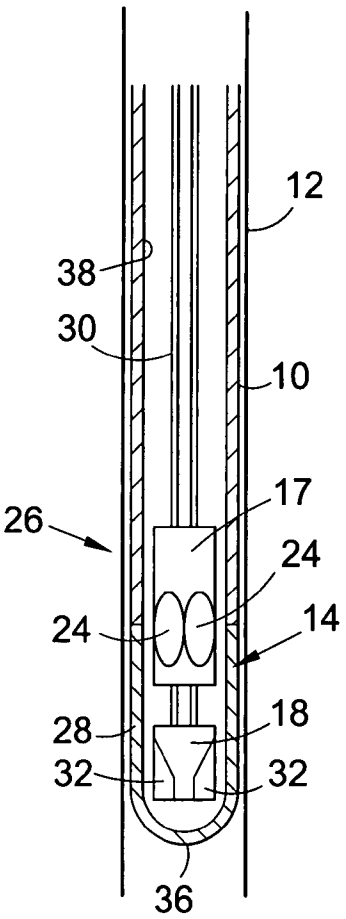
Figure 8:
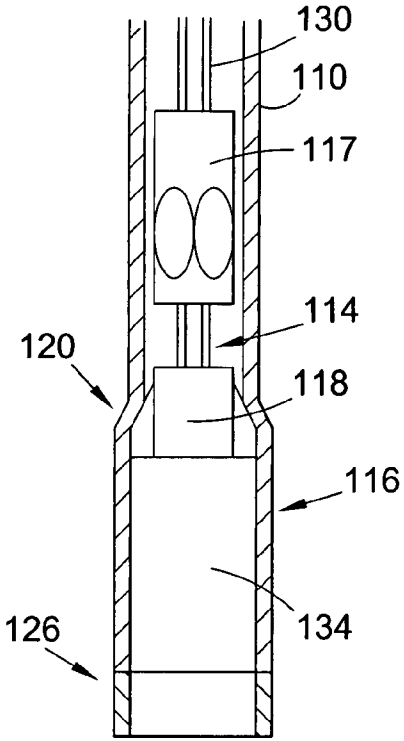
FIGS. 5-8 are longitudinal partial sectional views illustrating steps in a method of expanding tubing located in a borehole, and tubing expansion apparatus, in accordance with an alternative embodiment of the present invention.

FIG. 1 illustrates the liner 10 following location in the borehole 12. The liner 10 is typically suspended from a casing (not shown) located further up the borehole 12, and, following expansion and subsequent completion, allows further downhole procedures to be conducted, such as accessing hydrocarbon-bearing formations.

Figure 4:
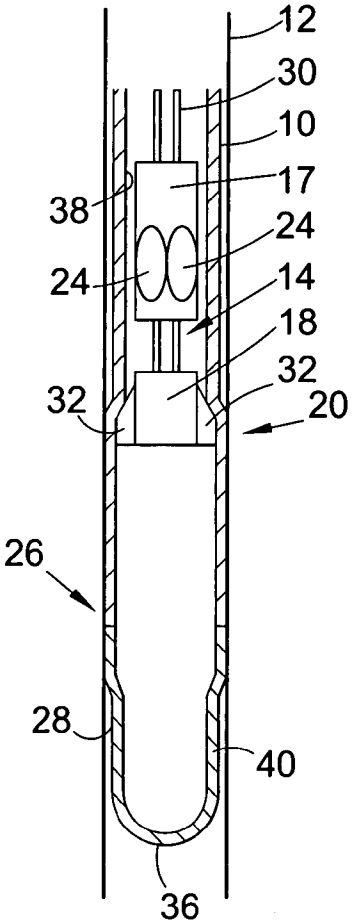
FIGS. 1-4 are longitudinal partial sectional views illustrating steps in a method of expanding tubing located in a borehole, and tubing expansion apparatus, in accordance with a preferred embodiment of the present invention.
Figure 3:
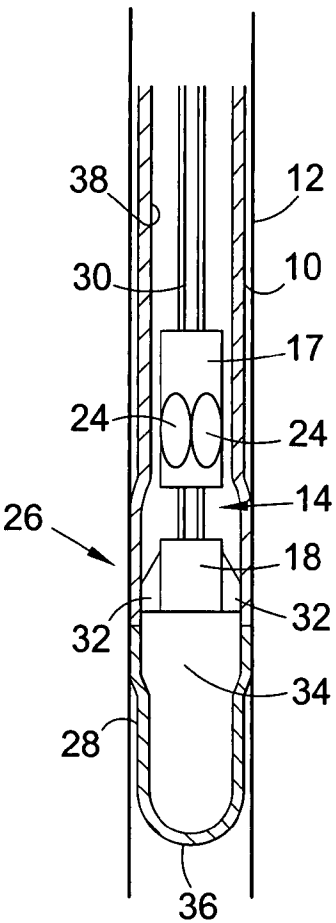
Figure 2:
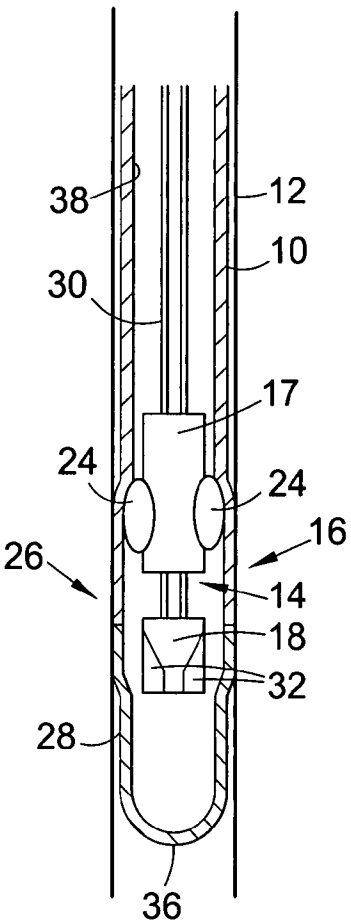

A tubing expansion apparatus 14 in accordance with a preferred embodiment of the present invention is made-up at surface and run into the liner 10, as shown in FIG. 1. The tubing expansion apparatus 14 includes a first expansion device 17 and a second expansion device 18. After location in the liner 10, the expansion apparatus 14 is activated and the first expansion device 17 diametrically expands a part 16 of the liner 10, as shown in FIG. 2. The second expansion device 18 is located in the expanded part 16 of the liner 10, as shown in FIGS. 2 and 3, and is then translated relative to the liner 10 to expand a further part 20 of the liner, as shown in FIG. 4.

The second expansion device 18 is translated along a desired axial length of the liner 10, typically along the entire length of the liner, and the liner 10 is thus diametrically expanded, facilitating further downhole procedures, whilst minimising any reduction in bore diameter of the borehole 12.

The tubing expansion apparatus 14 and its method of operation will now be described in more detail. The first expansion device 17 takes the form of a rotary expander device, and the second expansion device 18 takes the form of a collapsible expansion cone. The rotary expander device 17 includes a plurality of radially moveable roller expansion members 24 (two shown in the figures). The roller expansion members are mounted on pistons (not shown), and are urged radially outwardly from a retracted configuration to an expansion configuration, to selectively expand the liner 10. Devices of this type are disclosed in the applicant's International patent publication No. WO00/37766. The collapsible expansion cone 18 is moveable between a collapsed configuration shown in FIGS. 1 and 2 and an expansion configuration describing a larger, expansion diameter, shown in FIGS. 3 and 4. A collapsible cone of this type is disclosed in the applicant's UK patent application No.0304335.3 and European patent publication No. 0862681.

To expand the liner 10, the tubing expansion apparatus 14 is run in and located within the liner 10 with the rotary expander device 17 adjacent the part 16 of the liner 10 to be initially expanded. During run-in, the roller expansion members 24 of the rotary expander device 17 are in their retracted positions and the collapsible cone 18 is in the collapsed configuration.

When it is desired to expand the part 16 of the liner 10, the roller expansion members 24 of the rotary expander device 17 are urged radially outwardly to extended positions by application of fluid pressure to the pistons of the roller expansion members 24. This is achieved by circulating fluid through a tool string 30 coupled to the expansion apparatus 14. The device 17 is then rotated and translated a relatively short axial distance relative to the liner 10, to diametrically expand the part 16 of the liner 10, forming a garage or launcher for the cone 18.

The garage 16 is of a diameter substantially equal to the expansion diameter defined by the cone 18. During this translation of the rotary expander device 17, the collapsible cone 18 is also translated relative to the liner 10 and thus brought into the expanded part 16.

The rotary expander device 17 is then deactivated, such that the roller expansion members 24 may retract, for example, the members 24 may be urged inwardly during further passage through the unexpanded part of the liner 10. The collapsible cone 18 is then activated by applied fluid pressure, in a similar fashion to the rotary expander device 17, to urge expansion members 32 of the cone 18 to the expansion configuration of FIG. 3. It will be understood that both the rotary expander 17 and the collapsible cone 18 are fluid pressure activated. Accordingly, to prevent premature activation of the cone 18, the cone may be arranged to move to the expansion configuration at a higher pressure from the rotary expander 17. For example, the cone 18 may include a shear pin (not shown) or the like preventing movement of the expansion members 32 until a predetermined applied fluid pressure is reached, or a burst disc (not shown) isolating pressure activated parts of the cone until said applied pressure ruptures the disc. This activating pressure may be considerably higher than the operating pressure of the rotary expander 17.

The collapsible cone 18 is then translated relative to the liner 10 by an applied fluid pressure force. To achieve this, an end 26 of the liner 10 is initially sealed relative to the borehole 12 by a drillable liner 28, typically of an aluminium alloy or the like. Fluid is supplied under pressure through the tool string 30 to a location 34 between an end 36 of the drillable liner 28 and the cone 18, urging the cone 18 through the further part 20 of the liner 10. It will be understood that the cone 18 may be self-sealing with an inner wall 38 of the liner 10 when in the expansion configuration, or a wiper seal or the like (not shown) may be provided at a leading end of the cone 18. A force may be exerted through the tool string 30 to assist in translation of the cone 18, or alternatively to provide the entire force required to translate the cone 18. For example, a substantially continuous pull force may be exerted on the cone 18 from surface through the tool string 30. Alternatively, a series of short pull forces or pulses may be exerted on the cone 18. This may be achieved using a hydraulic jack or piston assembly (not shown) provided as part of the tool string 30. The jack may include a piston coupled to the cone 18, movable in a cylinder which is axially fixed relative to the liner 10. Movement of the piston thus translates the cone 18 relative to the liner 10. Further movement is permitted by translating the cylinder to reset the jack, thus allowing translation of the cone 18 through the liner 10 in a series of short movements. It will be understood that in a further variation, the cone 18 may be translated by a combination of these procedures, for example, a short initial pull using the jack, followed by further translation using the tool string 30.

Following expansion of the further part 20 of the liner 10, the cone 18 is returned to the collapsed configuration of FIG.

1 and the tubing expansion apparatus 14 returned to surface. A reduced diameter portion 40 of the drillable liner 28 is then drilled out, opening the expanded liner 10 to allow further downhole procedures to be conducted. Alternatively, the liner 28 may be at least partly dissolved in order to open the expanded liner 10. This may be achieved using a suitable fluid. For example, where the liner 28 is of a material such as an Aluminium alloy, Hydrogen Peroxide may be utilised to dissolve part or all of the liner 10. This may be achieved by spotting a defined volume of fluid downhole (a "pill") into the region of the liner 28. Where the liner 28 is of an alternative material, an appropriate alternative fluid may be selected.

It will be understood that in alternative embodiments of the invention, the tubing expansion apparatus 14 may be run into the borehole 12 together with the liner 10 and that, optionally, the liner 10 may at least initially be suspended within the borehole 12 through the connection with the tubing expansion apparatus 14. Thus following expansion of the part 16 of the liner 10, where the liner may be brought into engagement with the borehole 12, the liner 10 may then be self-supporting within the borehole 12.

It will be understood that by initially expanding the part 16 of the liner 10 to form the garage for the collapsible cone 18, this allows the cone 18 to be moved to the expansion configuration with little or no force exerted on the liner 10 which may otherwise hamper movement of the cone to the expansion configuration.

Turning now to FIGS. 5-8, there are shown longitudinal partial sectional views illustrating steps in a method of expanding tubing in accordance with an alternative embodiment of the present invention. The figures illustrate expansion of a tubing such as a liner 110 using a tubing expansion apparatus 114, and like components with the apparatus and method illustrated in FIGS. 1-4 share the same reference numerals, incremented by 100. For ease of reference, the borehole has been omitted from FIGS. 5-8.

The apparatus 114 is essentially similar to the apparatus 14 of FIGS. 1-4, except the apparatus includes a seal member 142 in the form of an expandable packer. Also, the liner 110 is open to the borehole at the end 126.

Figure 7:
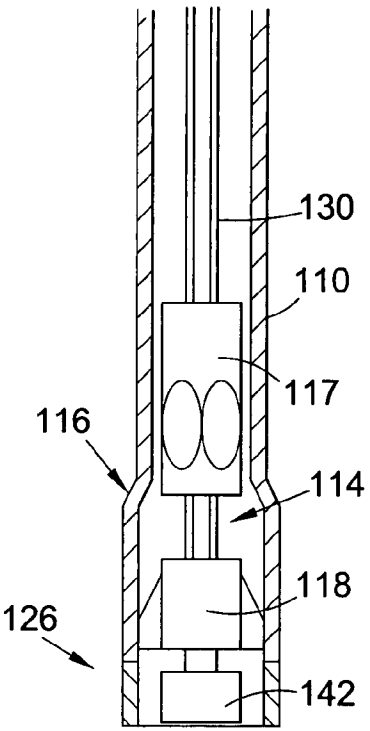
Figure 6:
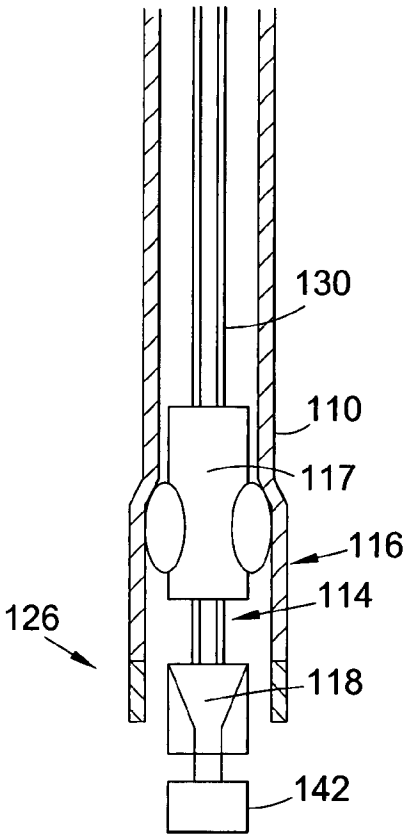
Figure 5:
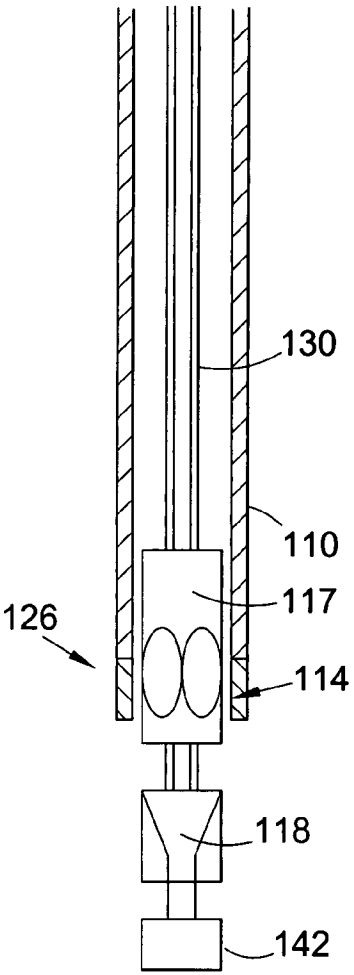

During expansion of the part 116 of the liner 110 to form a garage (FIG. 6), the collapsible cone 118 is brought into the expanded part 116 and moved to the expansion configuration (FIG. 7). The packer 142 is then inflated to seal with the liner 110, and is separated from the remainder of the tubing expansion apparatus 114. The packer 142 thus seals the lower end 126 of the liner 110, and allows translation of the cone 118 relative to the liner 110 by supply of pressurised fluid to the location 134. Following completion of expansion of the liner 110, the packer 142 may be drilled out or may be used in a further procedure, for example as a production packer for supporting and sealing a production tubing string within the liner 110.

Various modifications may be made to the foregoing within the scope of the present invention.

For example, the second expansion device may be initially located further up or shallower in the borehole than said part of the tubing to be expanded. Following expansion of said part of the tubing using the first expansion device, the second expansion device may then be translated relative to the tubing in a direction down the borehole to locate the expansion device in said expanded part of the tubing.

The first and second expansion devices may be run into the borehole separately, to expand said part and said further part of the tubing in two distinct expansion procedures. In a further alternative, said part of the tubing and said further part may be expanded using a single expansion device, and the expansion device may be initially located at least partly externally of the tubing. The expansion device may be pulled into the tubing (thereby expanding said part of the tubing) by a hydraulic jack or piston assembly of the type described above, and then translated to expand said further part by a force exerted on the expansion device through a tool string.

Said part of the tubing may be expanded using a fixed diameter expansion device such as a cone or mandrel, or by any other suitable method such as by application of fluid pressure, inflating an inflatable expansion member, or the like.

The invention claimed is:

1. An expandable tubing assembly comprising an expandable tubing adapted to be located in a borehole, and tubing expansion apparatus for expanding the expandable tubing, the tubing expansion apparatus comprising:

a removable liner at an end of the tubing which initially closes the tubing, wherein the liner remains in place relative to the tubing during expansion and is drillable to open the tubing;

a first expansion device for expanding part of the tubing in the borehole; and a second expansion device adapted to be located in said expanded part of the tubing and to be translated relative to the tubing to expand a further part of the tubing.

2. An expandable tubing assembly as claimed in claim 1, wherein the tubing is closed at a location between an end of the tubing and the second expansion device.

3. An expandable tubing assembly as claimed in claim 1, wherein the second expansion device is substantially self-sealing in the tubing.

4. An expandable tubing assembly as claimed in claim 1, wherein the second expansion device carries a seal.

5. An expandable tubing assembly as claimed in claim 1, wherein the second expansion device is a variable diameter expansion device.

6. An expandable tubing assembly as claimed in claim 1, wherein the second expansion device is a collapsible expansion device movable between a collapsed configuration and a larger diameter expansion configuration.

* * * * *